US008746788B2

(12) United States Patent
Su

(10) Patent No.: US 8,746,788 B2
(45) Date of Patent: Jun. 10, 2014

(54) FOLD-DOWN TABLET ASSEMBLY FOR CHAIR

(75) Inventor: Chih-Cheng Su, Dongguan (CN)

(73) Assignee: Dongguan Howen Plastic & Metal Products Co., Ltd., Dongguan (CN)

( * ) Notice: Subject to any disclaimer, the term of this patent is extended or adjusted under 35 U.S.C. 154(b) by 56 days.

(21) Appl. No.: 13/552,666

(22) Filed: Jul. 19, 2012

(65) Prior Publication Data

US 2014/0021750 A1 Jan. 23, 2014

(51) Int. Cl.

| | |
|---|---|
| ***A47B 39/00*** | (2006.01) |
| ***A47B 39/02*** | (2006.01) |
| ***A47B 83/02*** | (2006.01) |

(52) U.S. Cl.
USPC ..... 297/162

(58) Field of Classification Search
USPC ..... 297/162
See application file for complete search history.

(56) References Cited

U.S. PATENT DOCUMENTS

| | | | | |
|---|---|---|---|---|
| 3,197,254 | A * | 7/1965 | Hendrickson | 297/162 |
| 3,547,488 | A * | 12/1970 | Barnes | 297/162 |
| 6,073,997 | A * | 6/2000 | Koh | 297/162 X |
| 6,224,149 | B1 * | 5/2001 | Gevaert | 297/162 |
| 6,237,997 | B1 * | 5/2001 | Olson | 297/162 |
| 7,370,910 | B2 * | 5/2008 | Piretti | 297/162 |
| 7,478,868 | B2 * | 1/2009 | Figueras Mitjans | 297/162 |
| 7,695,061 | B2 * | 4/2010 | Olarte | 297/162 |
| 8,109,566 | B2 * | 2/2012 | Koh | 297/162 X |
| 2010/0090504 | A1 * | 4/2010 | Brink et al. | 297/162 |
| 2011/0101740 | A1 * | 5/2011 | Koh | 297/162 |
| 2012/0146367 | A1 * | 6/2012 | Weber et al. | 297/162 |
| 2012/0223548 | A1 * | 9/2012 | Sharber et al. | 297/162 X |

* cited by examiner

*Primary Examiner* — Rodney B White

(57) ABSTRACT

A fold-down tablet used in a chair is disclosed. The tablet includes a board, a torsion positioning mechanism, a shaft and an armrest. The torsion positioning mechanism is fixed to a side of the board for horizontally rotating and positioning the board. The shaft has a protrudent positioning bar and is fixed to the torsion positioning mechanism for making the board vertically rotatable. The armrest has a shaft hole for rotatably receiving the shaft and a slot communicating with the shaft hole. When the board is turned horizontally, the positioning bar is embedded into the slot to be restricted.

9 Claims, 7 Drawing Sheets

FOLD-DOWN TABLET ASSEMBLY FOR CHAIR

BACKGROUND OF THE INVENTION

1. Technical Field

The present invention relates to chairs, particularly to chairs with tablets.

2. Related Art

A chair with a tablet is very useful and always used in a classroom or meeting room. Such chairs can be divided into two types, the one is of a fixed tablet, and the other one is of a fold-down tablet. The fold-down tablet can be folded aside when not in use so that it is convenient to pass in and out for users.

A conventional fold-down tablet is connected to a chair only with a shaft but without a positioning or fold assist mechanism. This makes such a tablet unstable in use. Also, it is possible that a user's hand is jammed when he or she extends or folds the tablet. Some chairs are equipped with a positioning or rotation mechanism, but they are too complicated in structure and too expensive in cost.

SUMMARY OF THE INVENTION

An object of the invention is to provide a fold-down tablet for a chair, which uses a simplified structure to form a positioning effect and to provide a laborsaving way to operate.

To accomplish the above object, the fold-down tablet includes a board, a torsion positioning mechanism, a shaft and an armrest. The torsion positioning mechanism is fixed to a side of the board for horizontally rotating and positioning the board. The shaft has a protrudent positioning bar and is fixed to the torsion positioning mechanism for making the board vertically rotatable. The armrest has a shaft hole for rotatably receiving the shaft and a slot communicating with the shaft hole. When the board is turned horizontally, the positioning bar is embedded into the slot to be restricted.

DETAILED DESCRIPTION OF THE INVENTION

Figure 1:
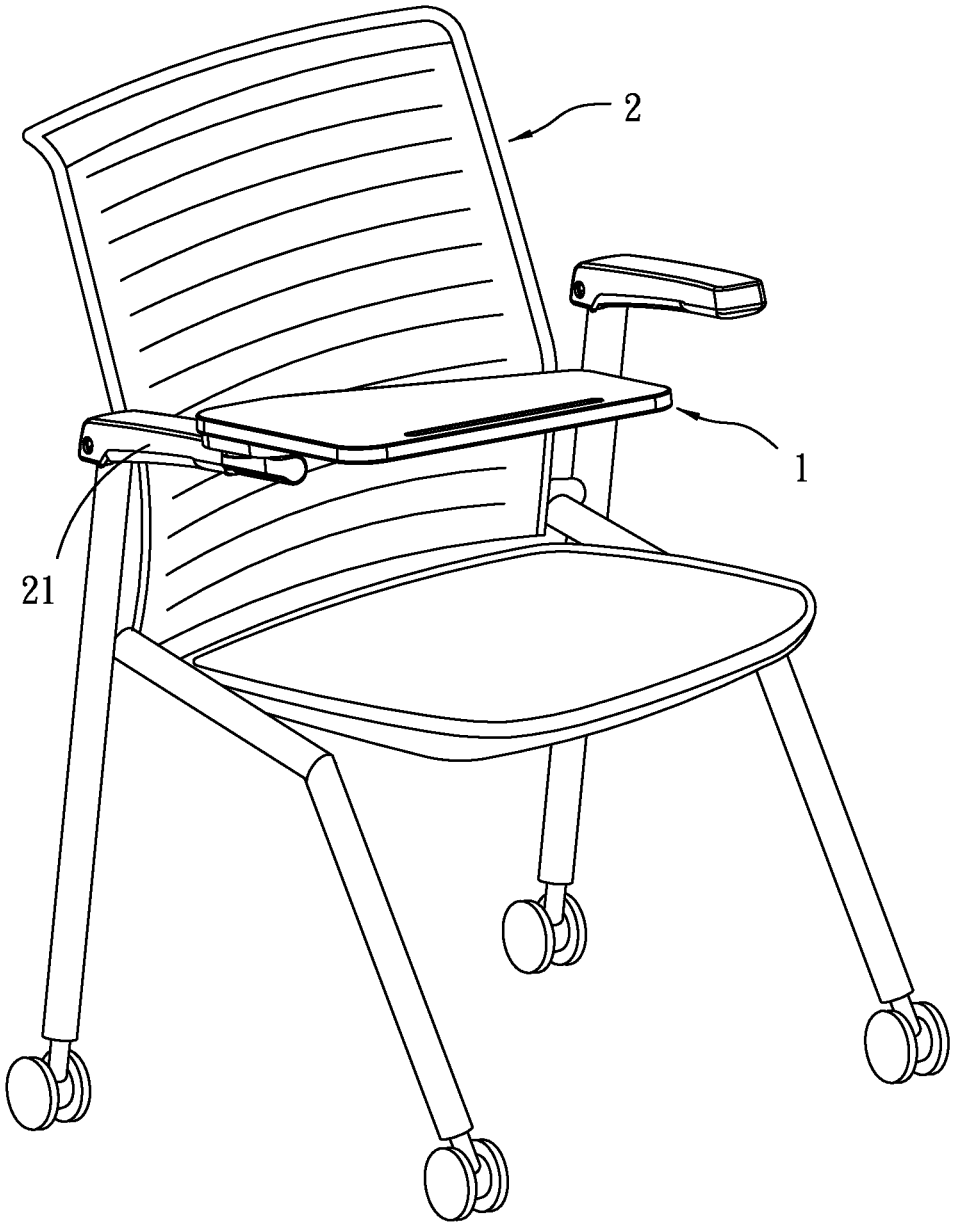
FIG. 1 is a schematic view of the invention in combination with a chair.

Please refer to FIG. 1. A tablet assembly 1 is disposed on an armrest 21 of a chair 2. The tablet assembly 1 may be turned into a horizontal status for writing or putting something or turned into a vertical status for storage.

Figure 2:
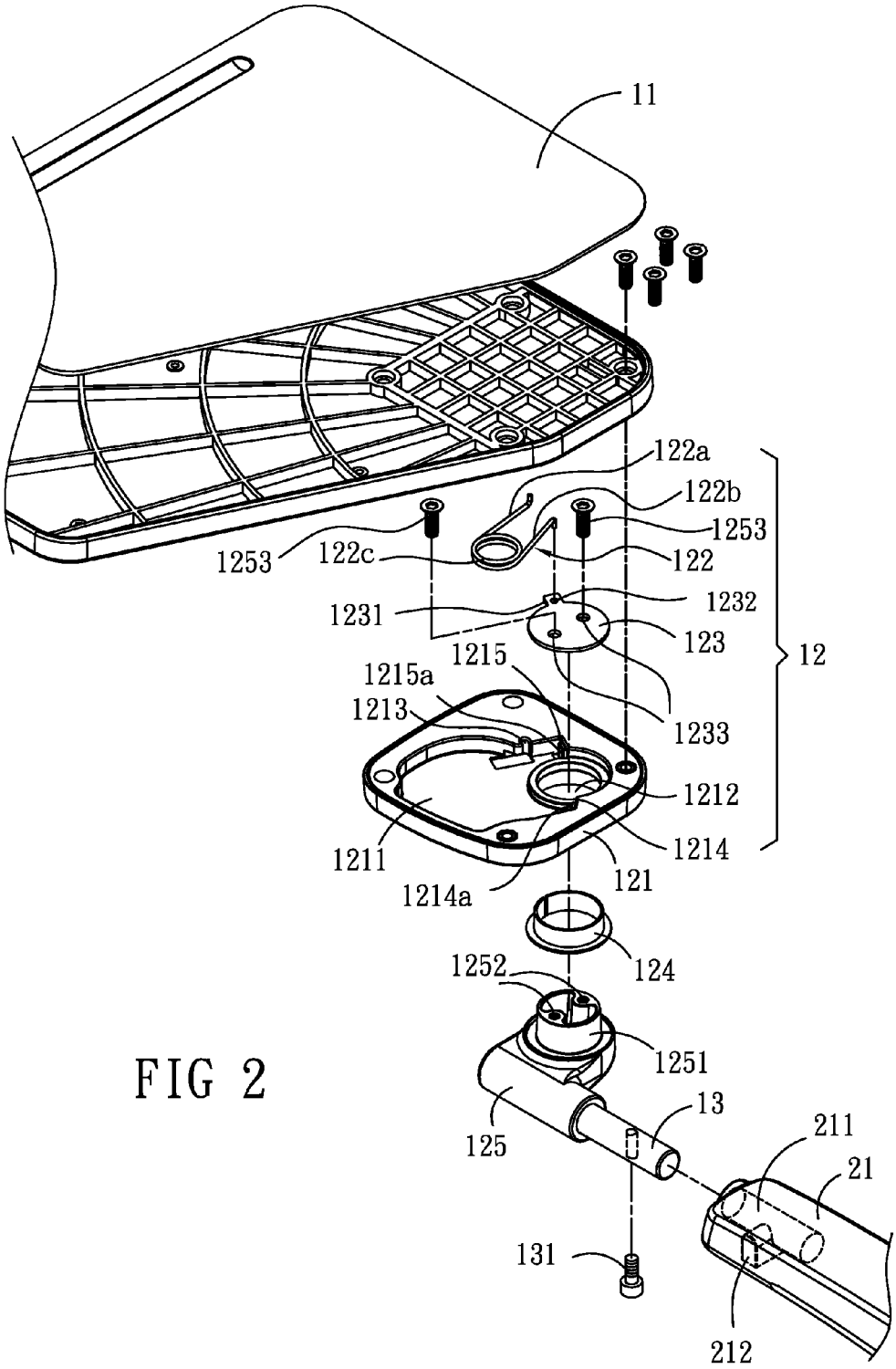
FIG. 2 is an exploded view of the invention.
Figure 3:
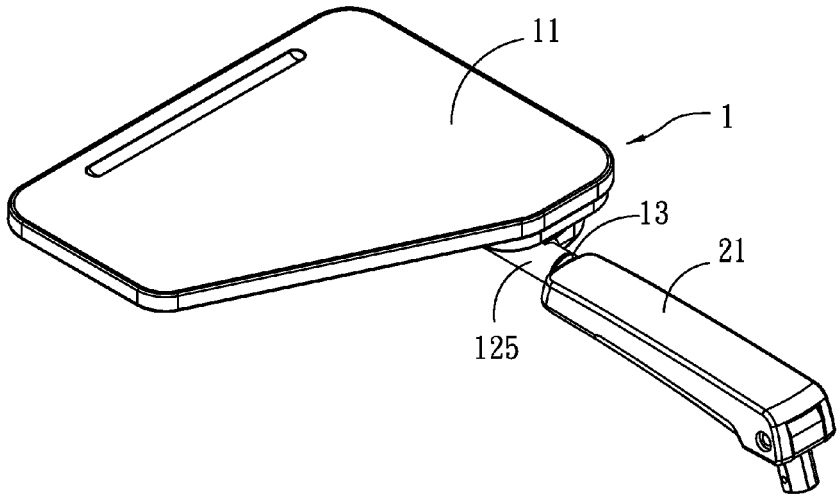
FIG. 3 is an assembled view of the invention.

Please refer to FIGS. 2 and 3. The tablet assembly 1 includes a board 11, a torsion positioning mechanism 12, a shaft 13 and an armrest 21. The torsion positioning mechanism 12 is fastened to a side of the board 11. By means of the torsion positioning mechanism 12, the board 11 can be rotated and positioned horizontally. And by means of the shaft 13, the board 11 can be rotated vertically relative to the armrest 21.

The torsion positioning mechanism 12 includes a casing 121, a torsion spring 122, a restriction plate 123, a sleeve 124 and a seat 125. The casing 121 is fixed on the board 11. There is a cavity 1211 and a round hole 1212 in the casing 121. The torsion spring 122 is received in the cavity 1211 and has a coil 122*c*, a first arm 122*a* and a second arm 122*b*. The cavity 1211 allows the torsion spring 122 to move. An edge of the cavity 1211 is formed with a stopping recess 1213 for fixing the first arm 122*a*. The restriction plate 123 is round in shape and correspondingly disposed over the round hole 1212. An edge of the restriction plate 123 is formed with a protrudent positioning plate 1231 with an inserting hole 1232 for being penetrated by the second arm 122*b* of the torsion spring 122. The restriction plate 123 is provided with two through holes 1233.

The seat 125 is connected to the shaft 13. The seat 125 is formed with a pivot base 1251 corresponding to the round hole 1212. The pivot base 1251 is axially inserted into the round hole 1212 so that the casing 121 can drive the board 11 to rotate on the pivot base 1251. Preferably, the pivot base 1251 is coated with damper grease for controlling rotation speed of the board 11. The pivot base 1251 is provided with two fixing holes 1252 corresponding to the through holes 1233. Thus the restriction plate 123 is fastened to the pivot base 1251 by inserting two screws 1253 through the through holes 1233 and fixing holes 1252. The sleeve 124 is disposed between the pivot base 1251 and the round hole 1212 to reduce vibration and friction between the casing 121 and pivot base 1251.

Two opposite sides of the cavity 1211 are separately formed with a first blocking portion 1214 and a second blocking portion 1215, which are located aside the round hole 1212 for blocking the positioning plate 1231. Thus the board 11 can be rotated only within the angular range defined between the two blocking portions 1214, 1215. Preferably, the angular range is 155 degrees. Each of the blocking portions 1214, 1215 can be additionally disposed with a buffer pad 1214*a*, 1215*a* for reduce noise and vibration.

Figure 4:
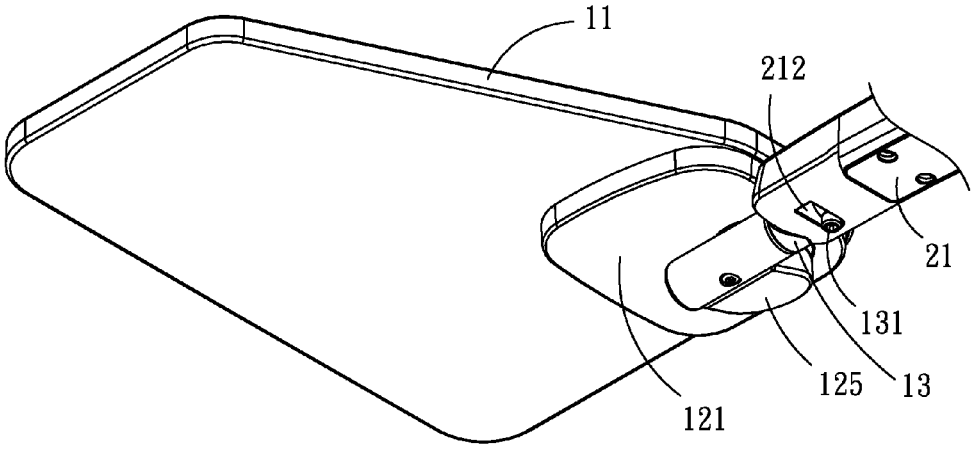
FIG. 4 is a partial view showing the positioning bar is stopped by the slot.

The armrest 21 has a shaft hole 211 for rotatably receiving the shaft 13. The shaft 13 may be coated with damper grease for controlling the rotation speed of the shaft 13. A protrudent positioning bar 131 is provided on the shaft 13. The bottom of the armrest 21 is formed with a slot communicating with the shaft hole 211 for receiving the positioning bar 131. Please refer to FIG. 4, when the board 11 is kept horizontal, the positioning bar 131 will be embedded into the slot 212 and stopped by an end of the slot 212 so that the board 11 will be positioned horizontally. Contrarily, when the board 11 is turned vertically, the positioning bar 131 will be completely embedded in the slot 212.

Figure 5:
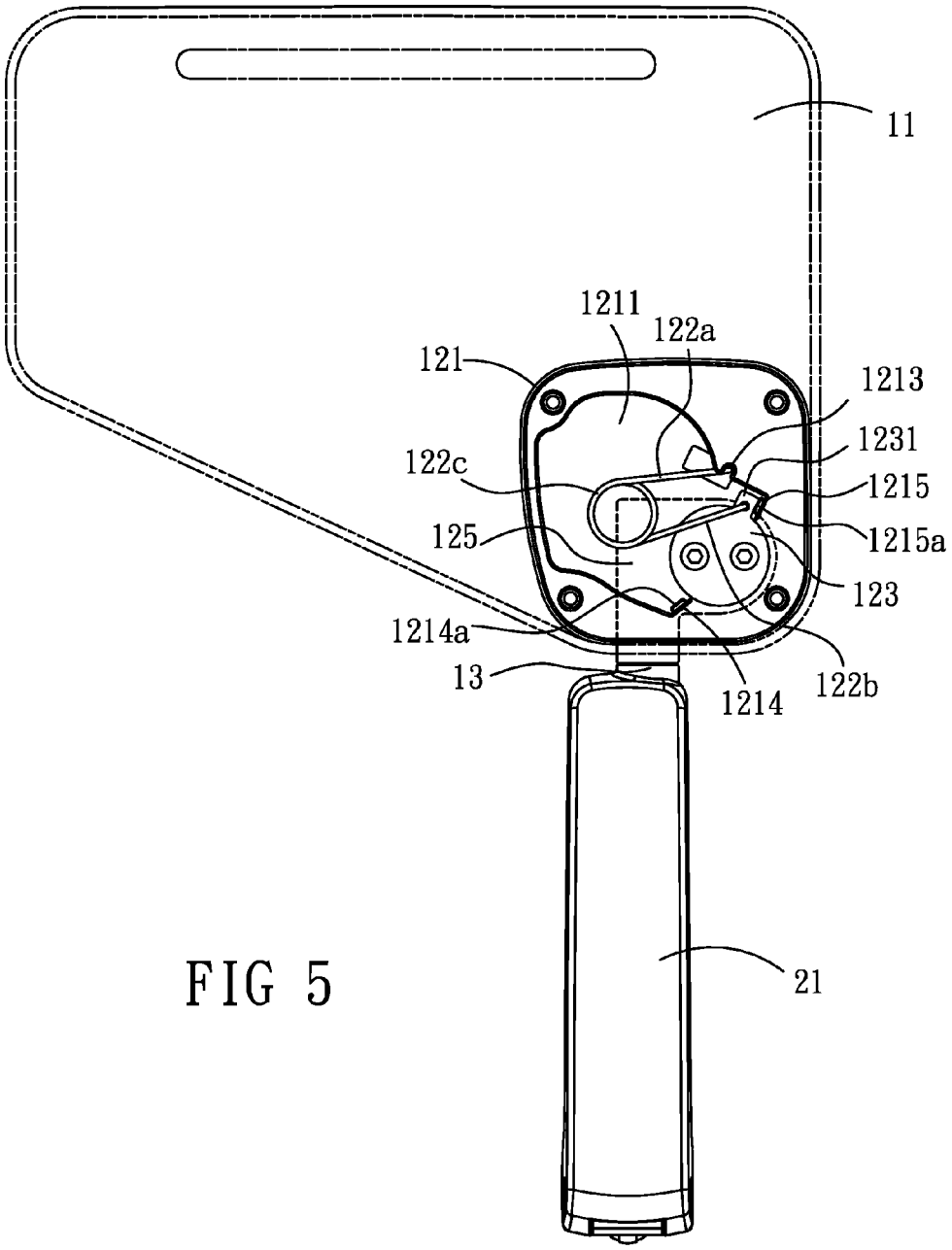
FIG. 5 shows the torsion positioning mechanism positions the board in an immovable status.

Please refer to FIG. 5, which shows the board 11 in a horizontally positioning status. As abovementioned, the first arm 122*a* is fixed in the stopping recess 1213 and the second arm 122*b* is fixed on the restriction plate 123. At this time, the torsion spring 122 is pressed to be immovable and thus the board 11 can be stably positioned as shown in FIG. 5.

Figure 6:
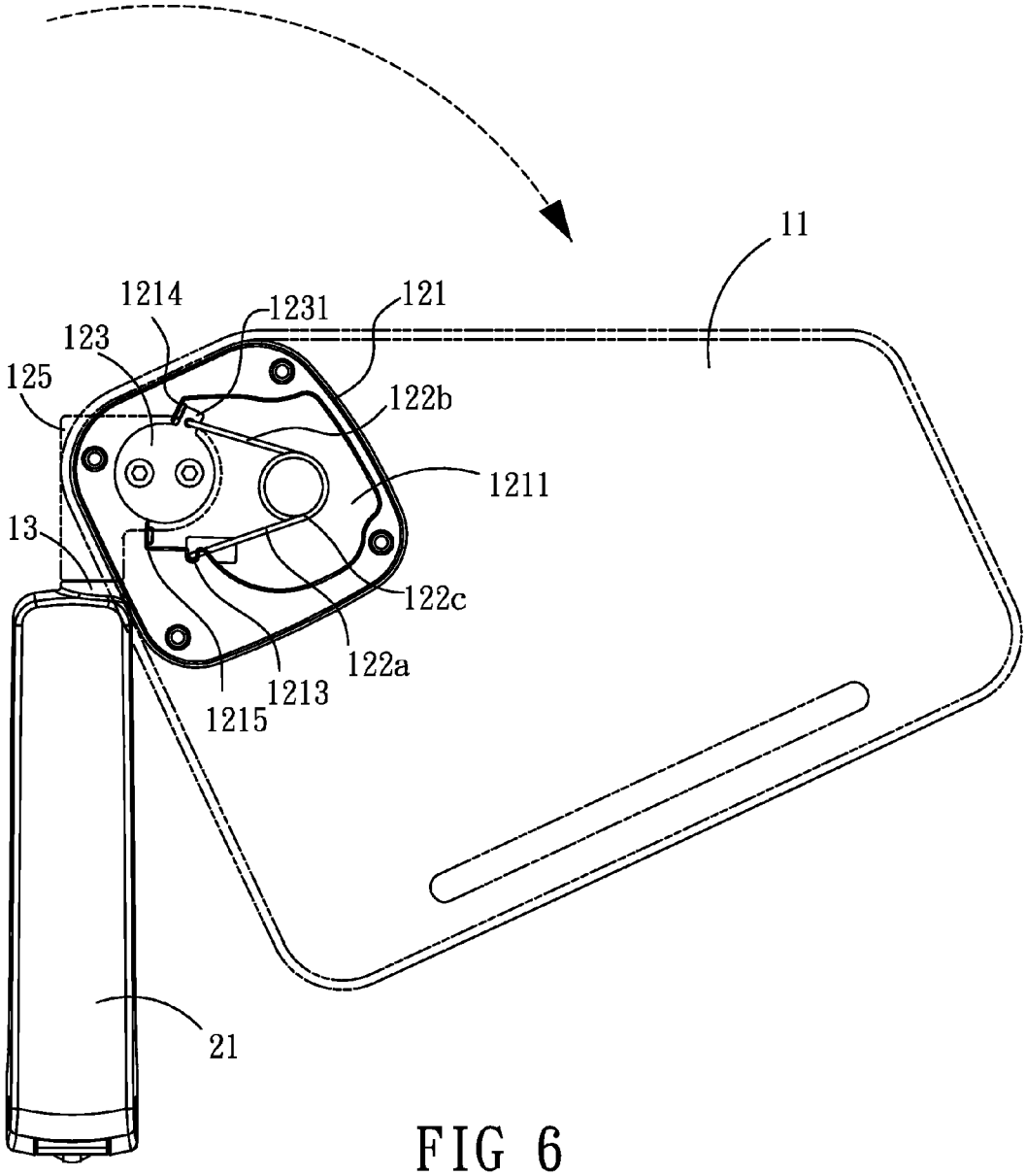
FIG. 6 shows the torsion positioning mechanism rotates the board.

Please refer to FIG. 6. When a user wants to fold the board 11, all he or she needs to do is slightly push the board 11 outwards. At this time, the casing 121 is driven by the casing 121 to change the position of the coil 122*c* of the torsion spring 122, the arms 122*a*, 122*b* will extend to assist the board 11 to automatically rotate outwards horizontally. Such rotation will be restricted within the angular range as abovementioned.

Figure 7:
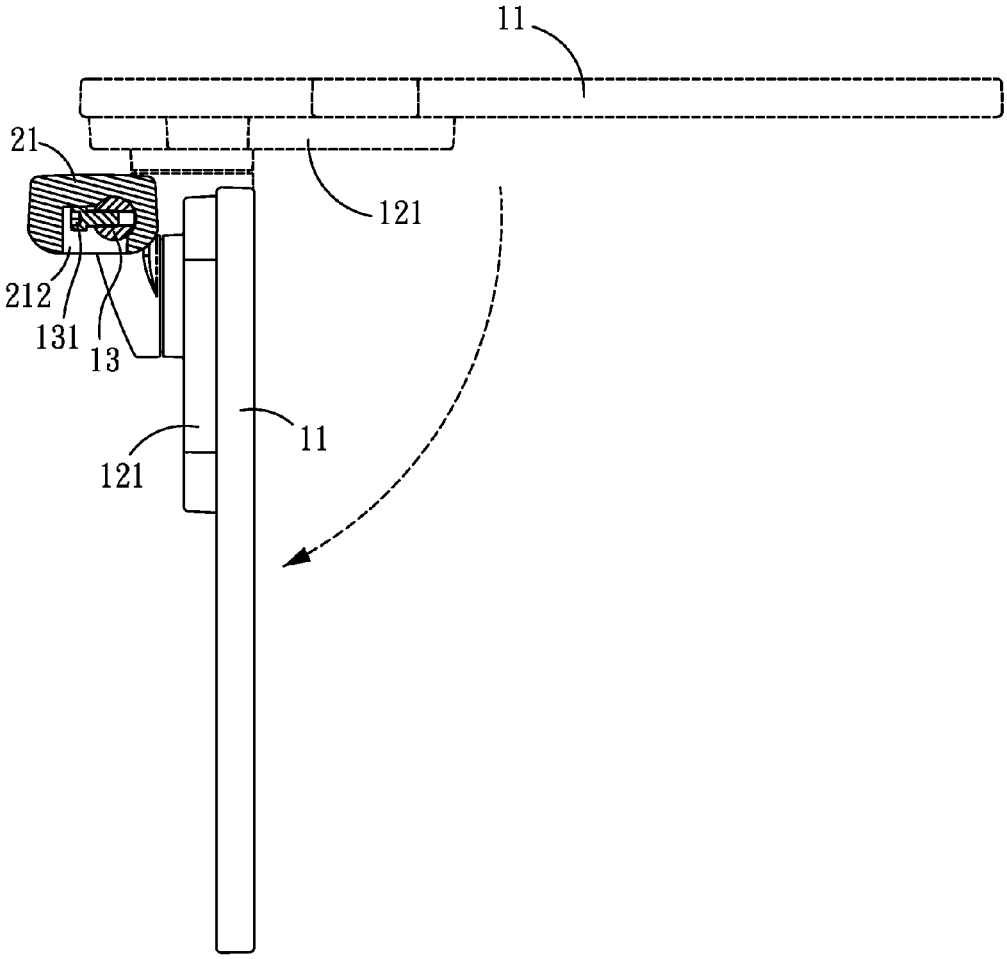
FIG. 7 shows the board is folded down.
Figure 8:
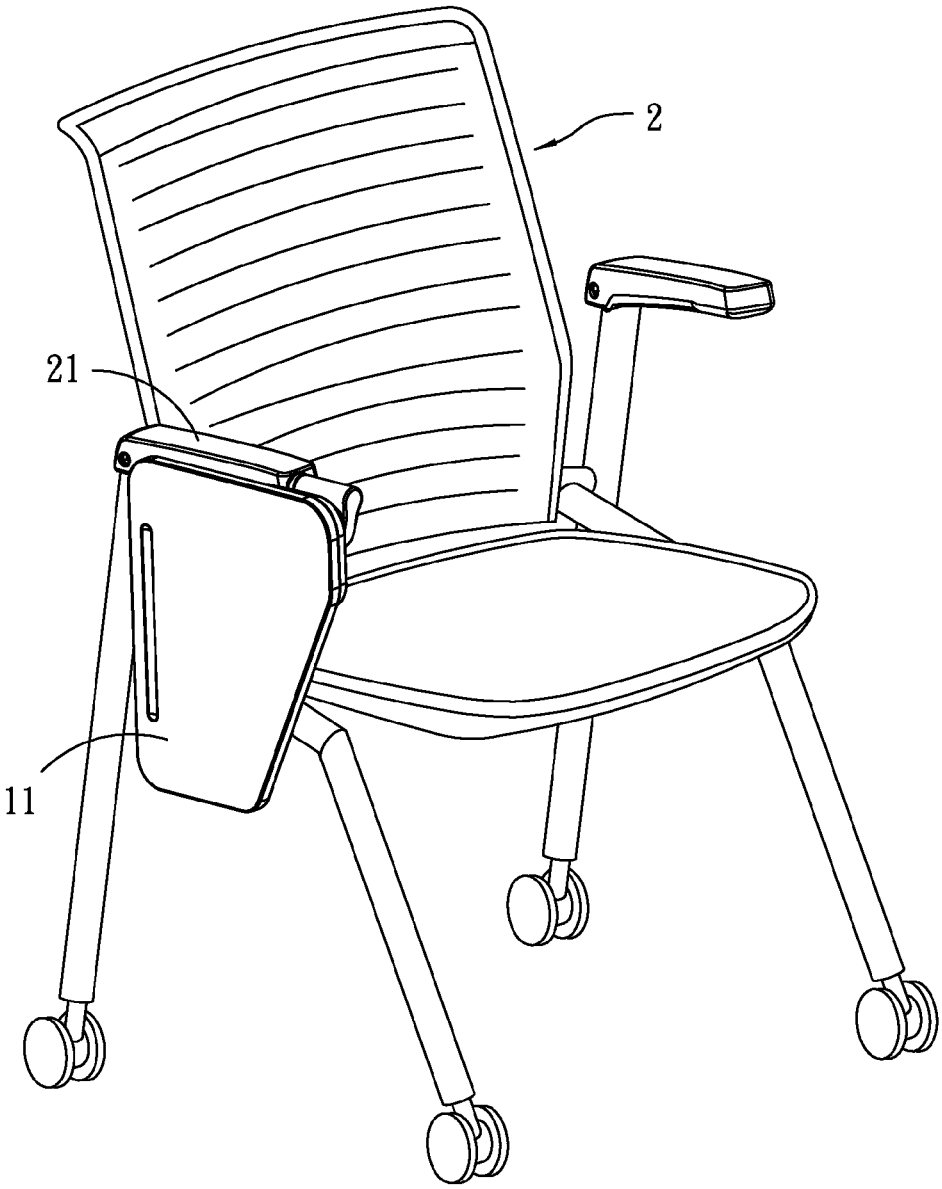
FIG. 8 shows the chair with the tablet which has been folded-down.

Please refer to FIGS. 7 and 8. When the board 11 is turned to the outside of the armrest 21, the board 11 will turn downwards through the shaft 13 due to its kinetic energy and weight. And the board 11 will be stopped by completely embedding the positioning bar 131 into the slot 212 as shown in FIG. 8.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A fold-down tablet for a chair, comprising:

a board;

a torsion positioning mechanism, fixed to a side of the board for horizontally rotating and positioning the board;

a shaft, having a protrudent positioning bar, and fixed to the torsion positioning mechanism for making the board vertically rotatable; and an armrest, having a shaft hole for rotatably receiving the shaft and a slot communicating with the shaft hole, wherein when the board is turned horizontally, the positioning bar is embedded into the slot to be restricted;

wherein the torsion positioning mechanism comprises:

a casing, fixed on the board, having a cavity and a round hole, wherein an edge of the cavity is formed with a stopping recess, and two opposite sides of the cavity are separately formed with a first blocking portion and a second blocking portion, which are located aside the round hole;

a seat, connected to the shaft, formed with a pivot base corresponding to the round hole, wherein the pivot base is axially inserted into the round hole so that the casing can drive the board to rotate on the pivot base;

a restriction plate, correspondingly disposed over the round hole, and having a protrudent positioning plate with an inserting hole formed on an edge of the restriction plate; and a torsion spring, received in the cavity, and having a coil, a first arm fixed in the stopping recess and a second arm fixed in the inserting hole;

wherein when the board is in a horizontally positioning status, the torsion spring is pressed to be immovable, when the board is being folded, push the board outwards to make the torsion spring extend for assisting the board to automatically rotate outwards horizontally, and the board is rotated only within an angular range defined between the two blocking portions.

2. The fold-down tablet of claim 1, further comprising a sleeve disposed between the pivot base and the round hole.

3. The fold-down tablet of claim 1, wherein the first and second blocking portions are provided with a buffer pad.

4. The fold-down tablet of claim 1, wherein the pivot base is coated with damper grease.

5. The fold-down tablet of claim 1, wherein the shaft is coated with damper grease.

6. A fold-down tablet for a chair, comprising a board, a torsion positioning mechanism fixed to a side of the board and a shaft, wherein the torsion positioning mechanism comprises:

a casing, fixed on the board, having a cavity and a round hole, wherein an edge of the cavity is formed with a stopping recess, and two opposite sides of the cavity are separately formed with a first blocking portion and a second blocking portion, which are located aside the round hole;

a seat, connected to the shaft, formed with a pivot base corresponding to the round hole, wherein the pivot base is axially inserted into the round hole so that the casing can drive the board to rotate on the pivot base;

a restriction plate, correspondingly disposed over the round hole, and having a protrudent positioning plate with an inserting hole formed on an edge of the restriction plate; and a torsion spring, received in the cavity, and having a coil, a first arm fixed in the stopping recess and a second arm fixed in the inserting hole;

wherein when the board is in a horizontally positioning status, the torsion spring is pressed to be immovable, when the board is being folded, push the board outwards to make the torsion spring extend for assisting the board to automatically rotate outwards horizontally, and the board is rotated only within an angular range defined between the two blocking portions.

7. The fold-down tablet of claim 6, further comprising a sleeve disposed between the pivot base and the round hole.

8. The fold-down tablet of claim 6, wherein the first and second blocking portions are provided with a buffer pad.

9. The fold-down tablet of claim 6, wherein the pivot base is coated with damper grease.

* * * * *